US007823870B2

(12) United States Patent
Suzuki

(10) Patent No.: US 7,823,870 B2
(45) Date of Patent: Nov. 2, 2010

(54) IMAGE FORMING APPARATUS

(75) Inventor: Tomoo Suzuki, Tokyo (JP)

(73) Assignee: Konica Minolta Business Technologies, Inc. (JP)

( * ) Notice: Subject to any disclaimer, the term of this patent is extended or adjusted under 35 U.S.C. 154(b) by 0 days.

(21) Appl. No.: 12/174,925

(22) Filed: Jul. 17, 2008

(65) Prior Publication Data

US 2009/0085275 A1 Apr. 2, 2009

(30) Foreign Application Priority Data

Sep. 27, 2007 (JP) ..... 2007-250980
Apr. 22, 2008 (JP) ..... 2008-111045

(51) Int. Cl.
*B65H 3/44* (2006.01)

(52) U.S. Cl. ..... 271/9.13; 271/9.01

(58) Field of Classification Search ..... 271/9.13, 271/9.01, 9.11, 9.09, 9.12, 225, 186
See application file for complete search history.

(56) References Cited

U.S. PATENT DOCUMENTS 4,941,023 A * 7/1990 Holmes et al. ..... 399/364
4,949,949 A * 8/1990 Holmes et al. ..... 271/3.03
5,259,606 A * 11/1993 Takahashi ..... 271/9.12
5,584,474 A * 12/1996 Viechter ..... 271/3.19
6,266,151 B1 * 7/2001 Tachibana et al. ..... 358/1.4
6,581,929 B2 * 6/2003 Hiramitsu ..... 271/228
6,785,478 B2 * 8/2004 Takahashi et al. ..... 399/16
6,976,672 B2 * 12/2005 Kawata ..... 271/9.11
7,289,760 B2 * 10/2007 Kotani ..... 399/392
2006/0071414 A1 * 4/2006 Kawatsu et al. ..... 271/225
2006/0214353 A1 * 9/2006 Carter et al. ..... 271/9.09
2008/0107433 A1 * 5/2008 Yamamoto et al. ..... 399/45

FOREIGN PATENT DOCUMENTS

JP 2005-41582 2/2005

* cited by examiner

*Primary Examiner*—Kaitlin S Joerger
(74) *Attorney, Agent, or Firm*—Cantor Colburn LLP

(57) ABSTRACT

An image forming apparatus includes: a common conveyance path through which a sheet fed from a sheet feed tray is conveyed from a registration roller to a transfer section; a direct conveyance path through which the sheet is directly fed from the sheet feed tray to the common conveyance path; a delay conveyance path in which the sheet after being branched from the direct conveyance path is joined to the common conveyance path, and is caused to delay in being fed from the sheet feed tray to the common sheet conveyance path; a conveyance section which conveys the sheet fed from the sheet feed tray to the transfer section; and a controller which controls the conveyance section to convey once the sheet fed from the sheet feed tray from the direct conveyance path to the delay conveyance path, and thereafter to convey to the common conveyance path.

16 Claims, 10 Drawing Sheets

IMAGE FORMING APPARATUS

This application is based on Japanese Patent Application Nos. 2007-250980 filed on Sep. 27, 2007, and 2008-111045 filed on Apr. 22, 2008, which are incorporated hereinto by reference.

BACKGROUND OF THE INVENTION

The present invention relates to an image forming apparatus wherein a sheet stacked on a sheet feed tray is fed and an image is formed on the sheet.

Image forming apparatuses such as a copying machine, a printer and facsimile machine are introduced in many offices, and a higher speed of the image forming apparatus and higher image quality are demanded by users. In recent years, electrophotographic image forming apparatuses are introduced also in the print industry, and a higher speed and higher image quality are demanded by users.

As an art to realize higher image quality, there is a technology in which physical properties of each sheet fed out of a sheet feed tray including, for example, a width and a whiteness degree, or, positions such as deviations, for example, are detected to correct image data, and an image is formed on the sheet based on the corrected image data.

In the technology described in Unexamined Japanese Patent Publication Application No. 2005-41582, for example, a sheet deviation sensor is provided on a conveyance path for sheets, then, image data are shifted in the main scanning direction on the memory to be corrected based on the results of the detection by the sensor, and an image is formed on a sheet based on the corrected image data. This technology makes it possible to take a deviation of each sheet into consideration and thereby to form a high image quality that is constantly at a fixed position from an edge of the sheet.

For forming an image by considering physical properties and positions of each sheet fed out of a sheet feed tray, it is necessary to detect a sheet that is fed from sheet feed tray 1000 by detection sensor 3000 installed on conveyance path 2000 as shown in FIG. 10, for example, and to correct image data based on results of the detection. Further, when realizing a higher speed while conducting correction of image data, it is necessary to feed sheets continuously from sheet feed tray 1000 by shortening an conveyance interval of sheets, and to detect physical properties and positions of each sheet with detection sensor 3000.

Since a certain period of time is needed from the moment when physical properties and others of each sheet are detected by the detection sensor 3000 to the moment when an image formed on photoreceptor 4000A arrives at transfer section 5000 after image data are corrected, it is necessary to detect physical properties and others of a sheet early, and to form images on photoconductor 4000A based on results of the detection in succession, for forming images on sheets fed continuously at short intervals.

When taking this point into consideration, it is necessary to arrange the detection sensor 3000 at the upstream side of the conveyance path 2000, and to make a length of a conveyance path between the detection sensor 3000 and the transfer section 5000 to be as long as possible so that a plurality of sheets may stay between the detection sensor 3000 and the transfer section 5000. In this way, physical properties of sheets can be detected early, and a higher speed can be realized.

However, if the conveyance path between the detection sensor 3000 and the transfer section 5000 is made to be longer linearly, an apparatus needs to be large in size. In addition, if the conveyance path between the detection sensor 3000 and the transfer section 5000 is deflected to be made longer for preventing a large-sized apparatus, removal of jammed sheets is difficult when a sheet jam takes place at the deflected portion.

SUMMARY OF THE INVENTION

Therefore, an objective of the invention is to provide a compact image forming apparatus wherein physical properties or positions of each sheet which has been fed are detected, and an image can be formed at high speed based on results of the detection.

For attaining the aforesaid objective, an image forming apparatus relating to the invention forming an image on a sheet has a following structure wherein a sheet feed section having a tray on which sheets are loaded, a sheet detector that detects physical properties or positions of each sheet fed from the aforesaid sheet feed section, an image forming section that forms an image based on results of the detection conducted by the sheet detector, a transfer section that transfers an image formed by the aforesaid image forming section onto a sheet, a common conveyance path that conveys a sheet fed from the sheet feed section to the transfer section from a registration roller, a direct conveyance path that feeds a sheet directly from the common conveyance path from the sheet feed section, a delay conveyance path that joins the common conveyance path after branching to the direct conveyance path, and feeds a sheet by delaying a sheet from the sheet feed section to the common conveyance path, a conveyance section that conveys a sheet fed from the sheet feed section to the transfer section and a controller that controls the aforesaid conveyance section are provided and the controller controls the conveyance section so that a sheet fed from the sheet feed section may be conveyed temporarily from the direct conveyance path to the delay conveyance path, and then, may be conveyed to the common conveyance path.

DETAILED DESCRIPTION OF THE PREFERRED EMBODIMENT

Figure 1:
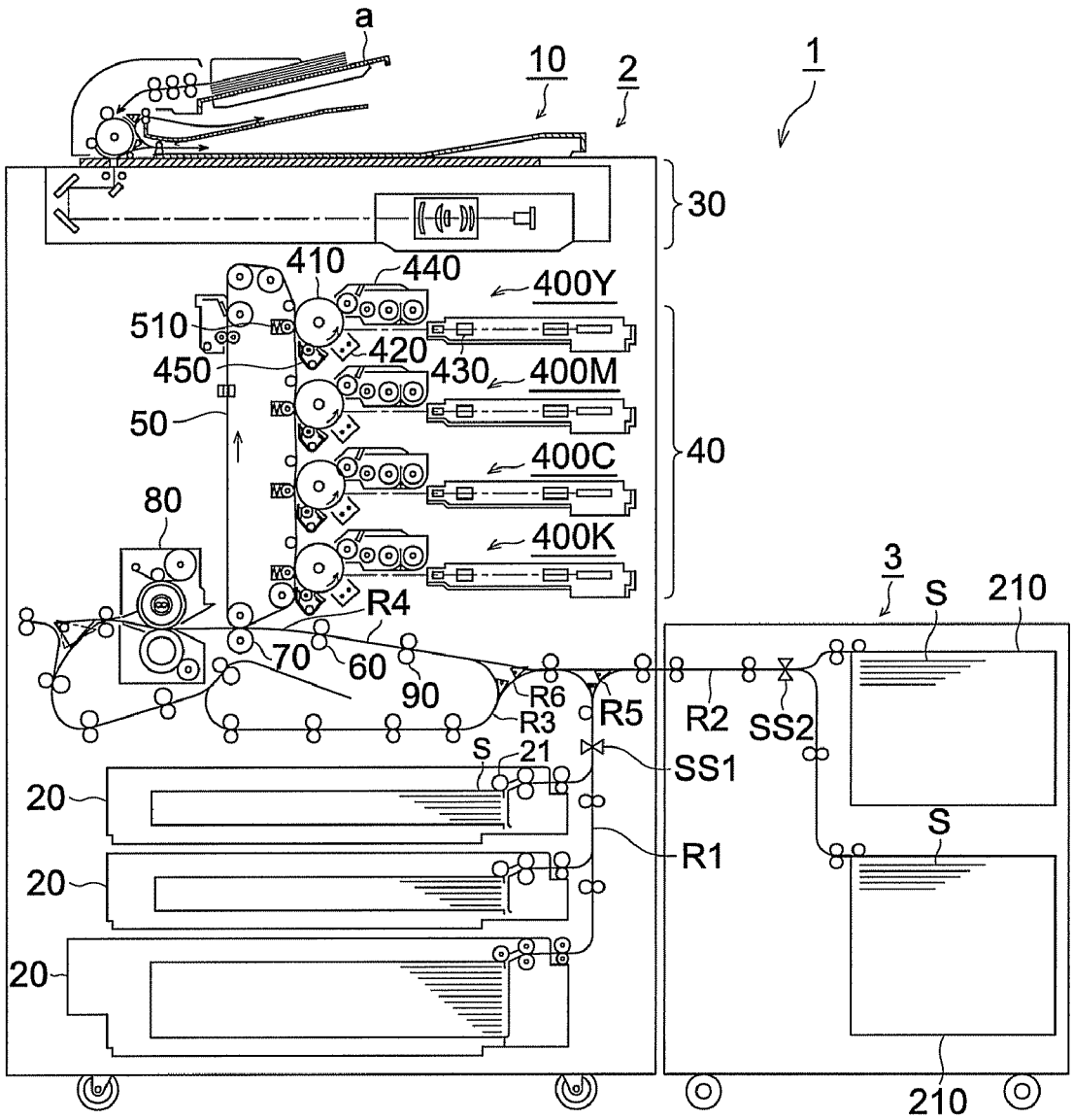
FIG. 1 is a central sectional view showing the internal constitution of an image forming apparatus.

FIG. 1 is a central sectional view showing the internal constitution of an image forming apparatus 1.

The image forming apparatus 1 is composed of apparatus main body 2 and optional sheet feed device 3.

The apparatus main body 2 is an apparatus main body of a tandem type having intermediate transfer belt 50.

A document set on document feed table of automatic document feeder 10 is conveyed to image reading section 30 by each conveyance roller.

The apparatus main body 2 has, at its lower portion, plural main body sheet feed trays 20. Image forming section 40 and intermediate transfer belt 50 are provided over the main body sheet feed tray 20, and image reading section 30 is provided on the upper portion of the apparatus main body.

The main body sheet feed tray 20 is of the structure to be capable of being drawn toward the front side of the apparatus (toward this side on the page in FIG. 1). In a plurality of main body sheet feed trays 20, there are stacked sheets S such as white sheets which are classified according to the size. Sheets S loaded in main body sheet feed trays 20 are fed by sheet feed roller 21.

Optional sheet feed device 3 is connected to the outside of the apparatus main body 2. In the optional sheet feed device 3, there are provided optional sheet feed trays 210 each having therein a large number of sheets S stacked. When printing a large number of sheets continuously, sheets S are fed out of the optional sheet feed trays 210 and images are formed on the sheets S.

Image forming section 40 has four sets of image forming units 400Y, 400M, 400C and 400K which form respectively toner images in respective colors of Y, M, C and K. The image forming units 400Y, 400M, 400C and 400K are arranged downward linearly in this order from the top, and each of them is of the same structure. If image forming unit 400Y for yellow color is taken as an example for the structure, the image forming unit 400Y has therein photoreceptor 410 that rotates counterclockwise, scorotron charging section 420, exposure section 430 and developing section 440.

Cleaning section 450 is arranged to include an area that faces the lowermost portion of photoreceptor 410.

Intermediate transfer belt 50 positioned at a central portion of the apparatus main body is in an endless shape and has a prescribed volume resistivity. Primary transfer electrode 510 is installed at a position that faces photoreceptor 410 through the intermediate transfer belt 50.

Next, an image forming method for forming a color image will be explained.

The photoreceptor 410 is driven to rotate by drum drive motor (not shown), and is charged by electric discharge of scorotron charging section 420 at negative polarity of, for example, −800 V. Next, optical writing corresponding to image information is conducted by exposure section 430 on photoreceptor 410, and an electrostatic latent image is formed on the photoreceptor 410. When the electrostatic latent image thus formed passes through developing section 440, the latent image is developed reversely by toner charged to be at negative polarity in the developing section through impression of negative polarity developing bias, whereby, a toner image is formed on the photoreceptor 410. The toner image thus formed is transferred onto intermediate transfer belt 50 that comes in pressure contact with the photoreceptor 410. Toner staying on the photoreceptor 410 after the transfer is removed by cleaning section 450.

When toner images which are respectively formed by image forming units 400Y, 400M, 400C and 400K are transferred onto intermediate transfer belt 50 to be superimposed, a color image is formed on the intermediate transfer belt 50. Sheet S is fed one sheet by one sheet from main body sheet feed tray 20 or from optional sheet feed tray 210, and is conveyed to loop roller 90 and to registration roller 60. The sheet S hits the registration roller 60 to be stopped temporarily, thus, a loop is formed by loop roller 90, and a skew of the sheet S is corrected. The sheet S is fed from the registration roller 60 at timing when the toner image on the intermediate transfer belt 50 synchronizes with the image position.

The sheet S fed by the registration roller 60 is guided by a guide plate to be fed in a transfer nip position that is formed by intermediate transfer belt 50 and transfer section 70. The transfer section 70 constituted by the roller presses the sheet S toward the intermediate transfer belt 50. When bias (for example, +500 V) whose polarity is opposite to that of toner is impressed on transfer section 70, a toner image on intermediate belt 50 is transferred onto sheet S by actions of electro static force. The sheet S is neutralized by a separating device (not shown) composed of a neutralizing needle to be separated from intermediate transfer belt 50, and is sent to fixing section 80 having a heat roller and a pressure roller. As a result, a toner image is fixed on sheet S, and the sheet S on which an image is formed is ejected to the outside of the apparatus.

Incidentally, image forming apparatus 1 in the present embodiment is one that forms a color image on a sheet through an electrophotographic system, but, an image forming apparatus relating to the invention is not limited to the present embodiment, and it may also be an image forming apparatus that forms a monochrome image.

Figure 2:
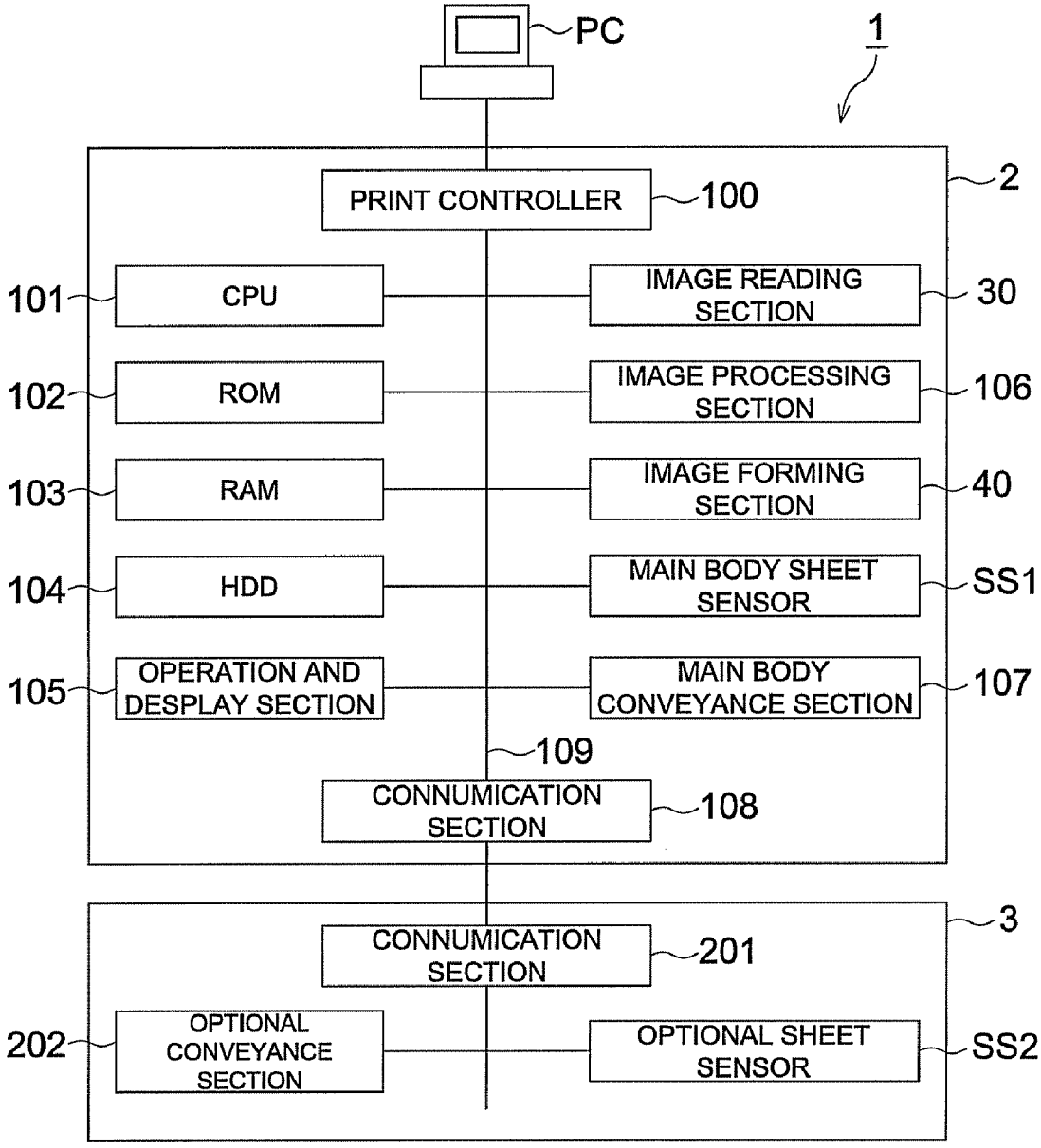
FIG. 2 is a block diagram of a control system of the image forming apparatus.

FIG. 2 is a block diagram of a control system of image forming apparatus 1, and in this case, typical ones only are shown.

CPU (Central Processing Unit) 101 is connected to ROM (Read Only Memory) 102 and to RAM (Random Access Memory) 103 through system bus 109. This CPU 101 reads out various programs stored in ROM 102 to develop them on RAM 103, and it controls operations of each section. Further, CPU 101 carries out various types of processes in accordance with programs developed in RAM 103, and it stores results of the processes in RAM 103, and displays them on operation and display section 105. Then, CPU 101 preserves the results of the processes stored in RAM 103 in the prescribed destination for preservation. In the meantime, in the present embodiment, CPU 101 constitutes a control section together with ROM 102 and RAM 103.

ROM 102 stores programs and data in advance, and it is composed typically of a semiconductor memory.

RAM 103 forms a work area that stores temporarily data processed by various types of programs carried out by CPU 101.

HDD 104 has a function to store image data of document images which are read by image reading section 30, and to store outputted image data. HDD 104 is of the structure wherein a plurality of metal discs each being coated or evaporated with magnetic materials are superimposed at regular intervals, and when a magnetic head approaches HDD 104 that is rotated by a motor at high speed, data are read or written.

Operation and display section 105 is one that allows various types of configurations. The operation and display section 105 is of a touch panel type, for example, and when a user inputs through the operation and display section 105, conditions concerning a color print or a monochrome print are established. The operation and display section 105 displays various types of information including network setting information.

The image reading section 30 reads out document images optically, and converts them into electric signals. When reading out a color document, the image reading section 30 generates image data having luminance information of 10 bits per one pixel for each of R, G and B.

Image data generated by the image reading section 30 and image data transmitted from a personal computer connected to image forming apparatus 1 are subjected to image processing conducted by image processing section 106. When color printing is carried out on image forming apparatus 1, image data respectively for R (Red), G (Green) and B (Blue) generated by the image reading section 30 are inputted in color conversion LUT in image processing section 106, and R, G and B data are color-converted into image data respectively for Y (Yellow), M (Magenta), C (Cyan) and Bk (Black). Then, for the color-converted image data, a tone reproduction characteristic is corrected, or, screen processing such as halftone is carried out referring to density correction LUT, and edge processing for fine-line enhancement is conducted.

Main body sheet sensor SS1 that functions as a sheet detector is arranged on main body conveyance path R1 for sheet S that is fed from main body sheet feed tray 20, and it detects a shift, a width and a degree of whiteness of each sheet conveyed. When the shift of sheet S is detected by main body sheet sensor SS1, image processing section 106 shifts image data in the main scanning direction on image memory, based on results of the detection, to correct it. Due to this, an image is formed at an appropriate position for a sheet.

Further, after a width of sheet S is detected by main body sheet sensor SS1, image processing section 106 corrects a magnification of image data, and after a degree of whiteness of sheet S is detected by main body sheet sensor SS1, image processing section 106 corrects a color tone of image data. After the magnification and the color tone of image data are corrected, images with high image quality can be formed on the sheet.

Main body conveyance section 107 conveys sheet S that is fed from main body sheet feed tray 20 arranged. A controller controls operations of the main body conveyance section 107.

Communication section 108 of the apparatus main body is connected with communication section 201 of an optional sheet feed device, and operations of optional sheet feed device 3 are controlled by a controller of apparatus main body 2.

Optional conveyance section 202 conveys sheet S that is fed from optional sheet feed tray 210. Operations of the optional conveyance section 202 are controlled by a controller.

Optional sheet sensor SS2 that functions as a sheet detector detects a shift, a width and a degree of whiteness of each sheet conveyed, in the same way as in the main body sheet sensor SS1, and results of the detections are reflected on correction of image data conducted by image processing section 106.

Figure 3:
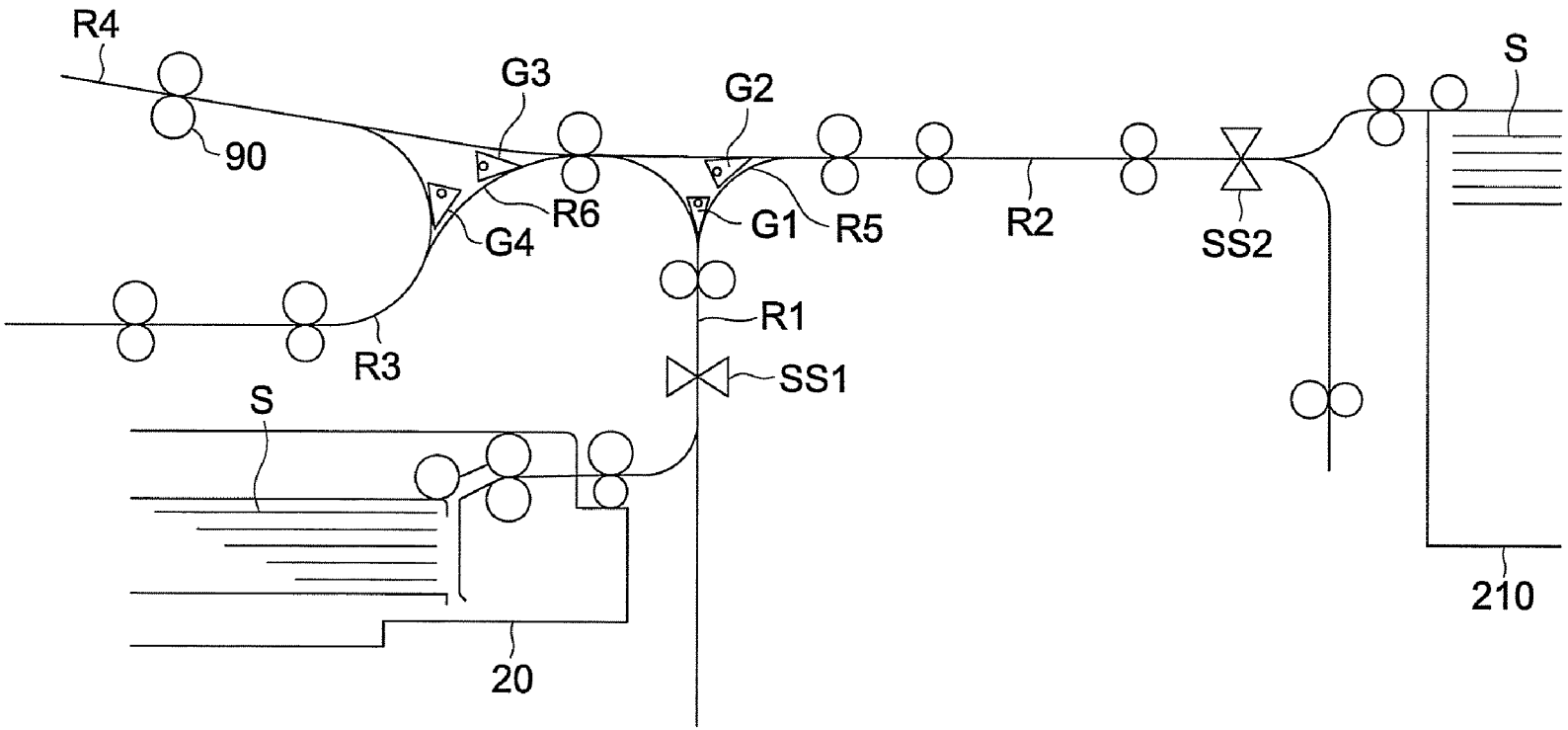
FIG. 3 is an enlarged diagram of a conveyance path in an apparatus main body and an optional sheet feed device.

Incidentally, in the present embodiment, main body conveyance section 107, optional conveyance section 202 and switching sections G1, G2, G3 and G4 shown in FIG. 3 constitute a conveyance section.

FIG. 3 is an enlarged diagram of a conveyance path in apparatus main body 2 and optional sheet feed device 3.

R1 represents a main body conveyance path through which sheet S fed from main body sheet feed tray 20 is conveyed, and it is a conveyance path covering from each main body sheet feed tray 20 to loop roller 90. R2 represents an optional conveyance path through which sheet S fed from optional sheet feed tray 210 is conveyed, and it is a conveyance path covering from each optional sheet feed tray 20 to loop roller 90. Further, R3 represents a reversing conveyance path that reverses sheet S on which an image has been formed on its front side, and it is a conveyance path covering from a diverging point at the downstream side of fixing section 80 to loop roller 90. R4 represents a common conveyance path through which sheet S conveyed from each conveyance path is conveyed to transfer section 70, and it is a conveyance path covering from loop roller 90 to transfer section 70. R5 represents the first joint conveyance path that conveys a sheet to optional conveyance path R2, diverging from main body conveyance path R1. Further, the first joint conveyance path R5 can convey a sheet to main body conveyance path R1 by diverging from optional conveyance path R2. R6 represents the second joint conveyance path that conveys a sheet to the reversing conveyance path R3 by diverging from main body conveyance path R1 or from optional conveyance path R2.

SS1 represents a main body sheet sensor that detects a shift of sheet S conveyed by main body conveyance path R1. SS2 represents an optional detection sensor that detects a shift of sheet S conveyed by optional conveyance path R2. The main body sheet sensor SS1 is arranged at the upstream side of the common conveyance path R4 in the sheet conveyance direction. In the same way, the optional sheet sensor SS2 is arranged at the upstream side of the common conveyance path R4 in the sheet conveyance direction.

On the conveyance path, there are installed a plurality of switching sections G1, G2, G3 and G4 by which a conveyance path for sheet S is switched. The switching section G1 switches so that the sheet S conveyed from main body conveyance path R1 may be conveyed to optional conveyance path R2, or to common conveyance path R4. The switching section G2 switches so that the sheet S conveyed from the optional conveyance path R2 may be conveyed to the main body conveyance path R1, or to the common conveyance path R4. The switching section G3 switches so that the sheet S conveyed from the main body conveyance path R1 or from the optional conveyance path R2 may be conveyed to reversal conveyance path R3, or to the common conveyance path R4.

When realizing speeding up by detecting a shift and others of each sheet that is fed from a sheet feed tray and by correcting image data, it is necessary to feed sheets from the sheet feed tray continuously by shortening an interval for conveyance, and to detect a shift and others of each sheet one after another with a sheet detector.

Since it takes a fixed amount of time for an image formed on photoreceptor 410 to arrive at transfer section 70 after shift and others of sheet S are detected by a sheet detector and image data are corrected, it is necessary to detect a shift and others of the sheet S in their early stages, and to form images on the photoreceptor 410 in order based on results of the detection.

When the foregoing is taken into consideration, a conveyance distance between the sheet detector and transfer section 70 needs to be long so that plural sheets S may stay at a space between the sheet detector and the transfer section to be delayed. For the reason mentioned above, conveyance paths are switched by switching sections G1, G2, G3 and G4 so that a conveyance distance between the sheet detector and transfer section 70 may be controlled to be long.

The aforesaid conveyance control for delaying the sheets may be conducted for a specific print job. The specific print job is a print job wherein a high quality mode is established and a low speed mode is not established in establishment information for print job. The high quality mode is a mode wherein a shift, a width and a degree of whiteness of sheet S fed out of a sheet feed tray are read, then, image data are corrected and an image is formed on the sheet S, thus, printing is carried out on a high image quality basis and at a prescribed position on the sheet. In the low speed mode, the sheet is conveyed at a low speed for avoiding troubles, because sheet jamming tends to be caused by conditions of the conveyance path when sheet S is a thick sheet. Further, some users allow a sheet to be outputted at a low speed provided that a quality of the sheet is high.

These points are explained as follows, referring to FIG. 4.

Figure 4:
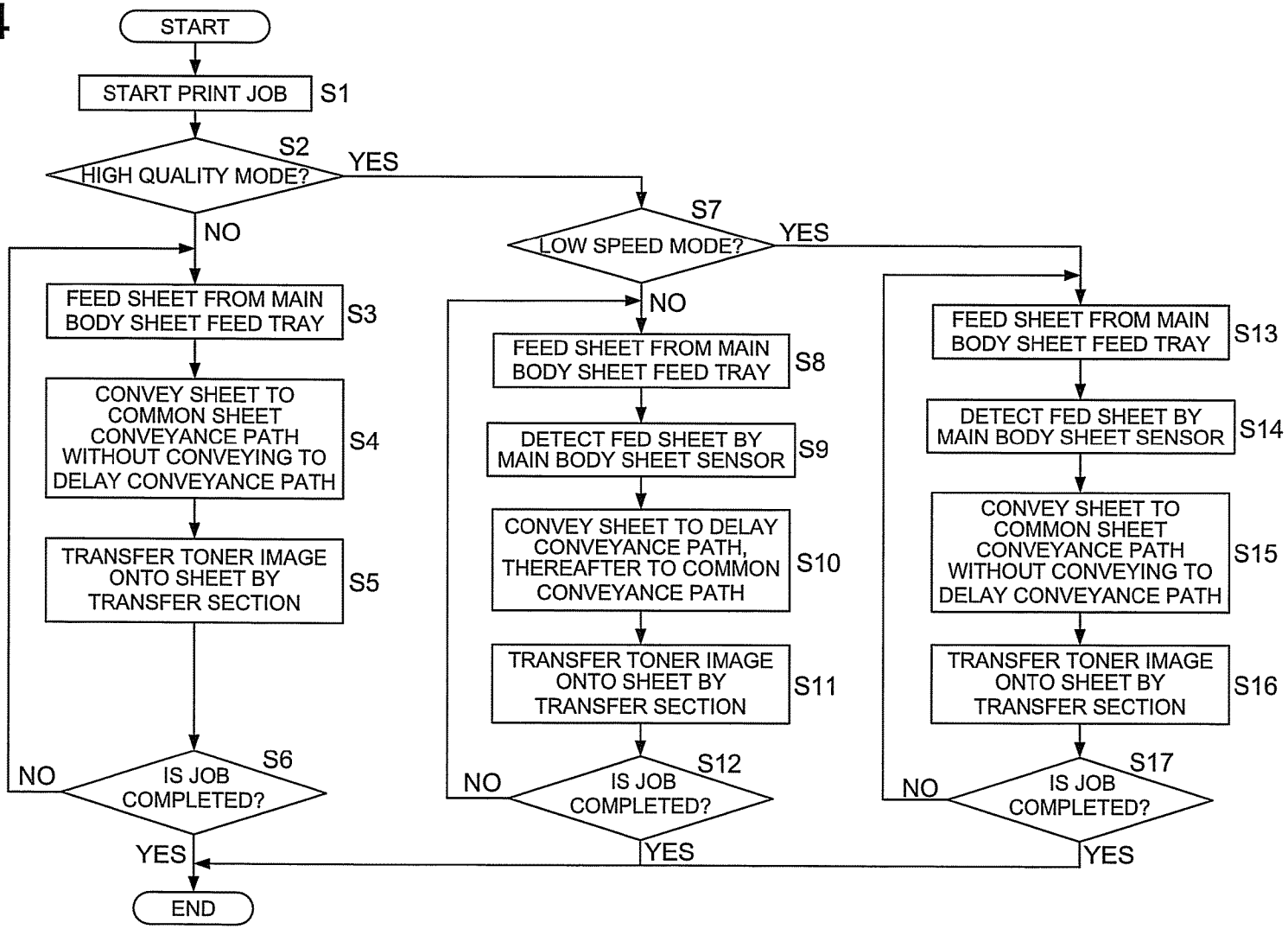
FIG. 4 is a flow chart showing operations for conveying a sheet that is fed out of a sheet feed tray by switching a conveyance path.

FIG. 4 is a flow chart showing operations for conveying by switching a conveyance path for sheet S that is fed out of main body sheet feed tray 20.

First, actions for the print job established in operation and display section 105 of image forming apparatus 1 and for the print job received from PC representing an outer terminal are started (step S1).

Next, establishment information of the print job is judged whether it is of a high quality mode or not, based on establishment information of the print job (step S2).

When the print job is judged not to be of a high quality mode in step S2 (Step S2; No), image forming is conducted without detecting a sheet with main body sheet sensor SS1, because the print job is one wherein no importance is attached to quality. Specifically, for the print job which is not of a high quality mode, namely, the print job other than a specific print job, sheet S is fed from main body sheet feed tray 20 (step S3), then, sheet S is conveyed directly to common conveyance path R4 without conveying the sheet S to a delay conveyance path (step S4), and a toner image is transferred onto sheet S by transfer section 70 (step S5). In the explanation by using FIG. 4, sheet S is fed from main body sheet feed tray 20, and sheet S is conveyed directly to common conveyance path R4 to be conveyed to transfer section 70, without being conveyed to optional conveyance path R2 representing a delay conveyance path and reversal conveyance path R3. Operations covering from step S3 to step S5 are repeated until the print job is completed.

On the other hand, when the establishment information of the print job is judged to be of a high quality mode in step S2 (Step S2; Yes), the print job is judged next whether it is of a low speed mode or not based on the establishment information (step S7). The print job is judged in step S7 whether it is of a low speed mode or not in step S7, and switching of conveyance path is controlled.

When the print job is judged not to be of a low speed mode in step S7 (Step S7; No), sheet S is conveyed by considering that a plurality of sheets S are detected by main body sheet sensor SS1 to acquire information such as a shift in its early stage and by considering a period of time during which image data are corrected and an image formed on photoreceptor 410 arrives at transfer section 70. Specifically, sheet S is fed from main body sheet feed tray 20 (step S8), and the sheet S thus fed is detected by main body sheet sensor SS1 (step S9). Then, for securing the conveyance distance to be long, sheet S is conveyed temporarily to a delay conveyance path, and then, sheet S is conveyed to common conveyance path R4 (step S10), and a toner image is transferred onto sheet S by transfer section 70 (step S11). Operations covering from step S8 to S11 will be explained in detail as follows, referring to FIG. 5 and FIG. 6.

Figure 5:
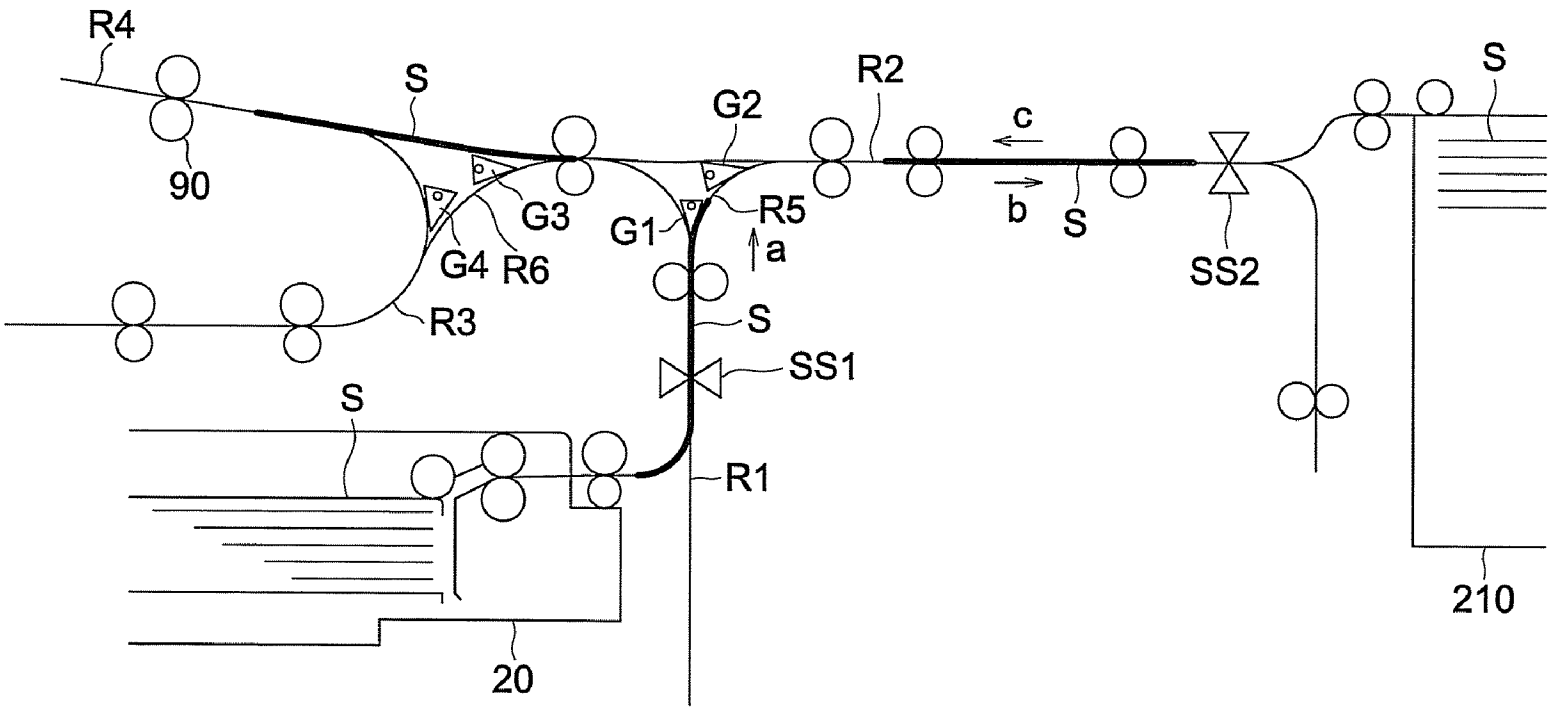
FIG. 5 is an illustration showing configuration for conveying a sheet to an optional conveyance path temporarily from a conveyance path of a main body.
Figure 6:
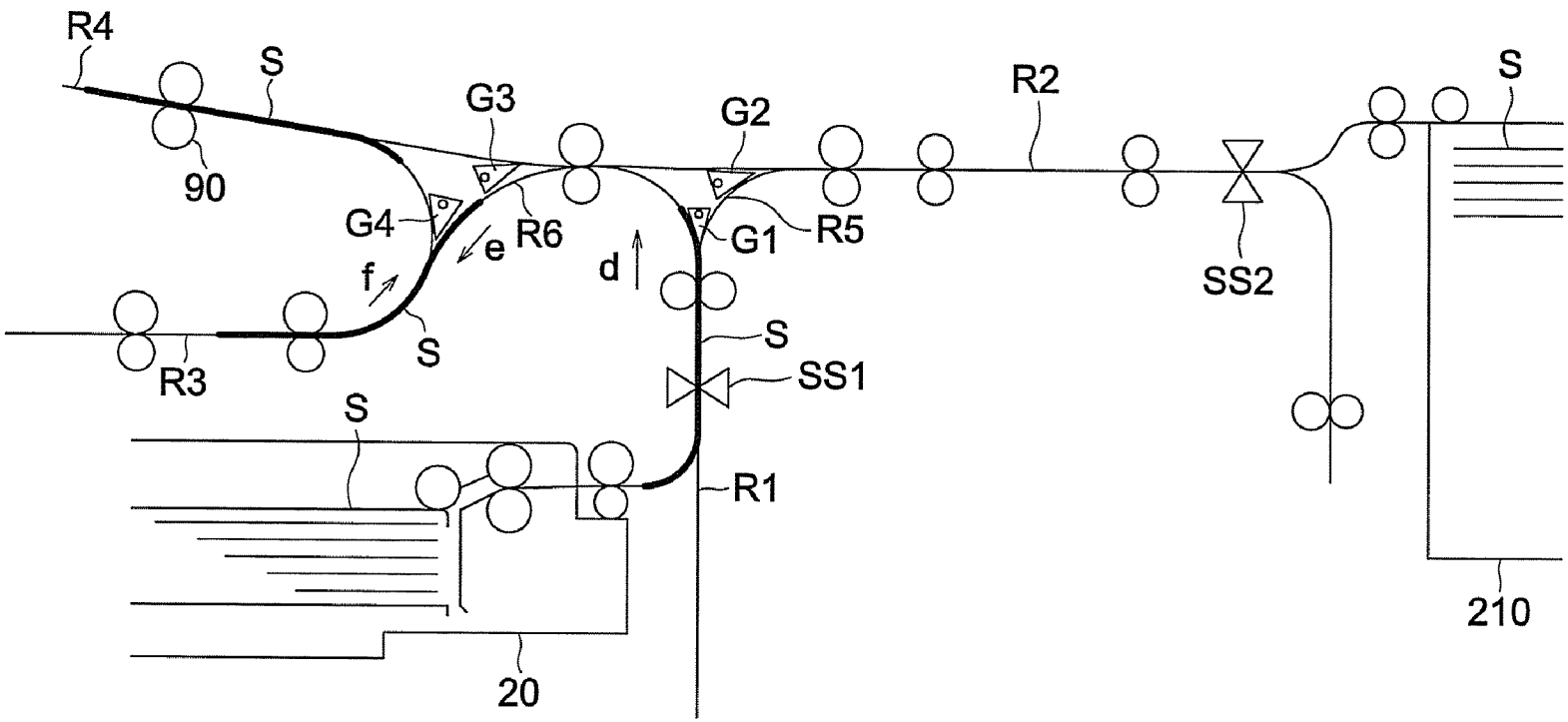
FIG. 6 is an illustration showing configuration for conveying a sheet to a reversal conveyance path temporarily from a conveyance path of a main body.

FIG. 5 is an illustration showing how sheet S is conveyed temporarily from main body conveyance path R1 to optional conveyance path R2. FIG. 6 is an illustration showing how sheet S is conveyed temporarily from main body conveyance path R1 to optional conveyance path R2. FIG. 6 is an illustration showing how sheet S is conveyed temporarily from main body conveyance path R1 to reversal conveyance path R3. Incidentally, in FIG. 5, main body conveyance path R1 corresponds directly to the conveyance path, and optional conveyance path R2 corresponds to a delay conveyance path. In FIG. 6, main body conveyance path R1 corresponds directly to the conveyance path, and reversal conveyance path R3 corresponds to a delay conveyance path.

First, in the explanation of the embodiment shown in FIG. 5, sheet S fed from main body sheet feed tray 20 advances through main body conveyance path R1 in the direction a, after being detected by main body sheet sensor SS1 for a shift and others. Then, sheet S is caused to advance through first joint conveyance path R5 in the direction b by operations of switching section G1, and is conveyed temporarily to optional conveyance path R2 representing a delay conveyance path. Next, sheet S follows a route of a switchback to advance in the direction c, to be conveyed to transfer section 70 through common conveyance path R4. If the conveyance path between main body sheet sensor SS1 and transfer section 70 is secured to be long temporarily, by switching the conveyance path so that sheet S may be conveyed through optional conveyance path R2, it is possible to feed sheets S continuously from main body sheet feed tray 20 by shortening a conveyance interval, and thereby to acquire information such as a shift of each of plural sheets in its early stage. It is further possible to cause sheet S to stay on the conveyance path and thereby to delay the conveyance thereof for the period of time during which the image data are corrected and an image formed on photoreceptor 410 arrives at transfer section 70.

Next, in the explanation about an embodiment shown in FIG. 6, sheet S fed from main body sheet feed tray 20 is detected in terms of a shift by main body sheet sensor SS1, and advances through main body conveyance path R1 in the direction d. Then, owing to operations of switching sections G1 and G3, sheet S advances from second joint conveyance path R6 in direction e, and is conveyed temporarily to reversal conveyance path R3 representing a delay conveyance path. Next, sheet S follows a route of a switchback to advance in the direction f, and is conveyed to transfer section 70 through common conveyance path R4. If the conveyance path between main body sheet sensor SS1 and transfer section 70 is secured to be long temporarily, by conveying sheet S to reversal conveyance path R3, it is possible to feed sheets S continuously from main body sheet feed tray 20 by shortening a conveyance interval, and thereby to acquire information such as a shift of each of plural sheets in its early stage. It is further possible to cause sheet S to stay on the conveyance path and thereby to delay the conveyance thereof for the period of time during which the image data are corrected and an image formed on photoreceptor 410 arrives at transfer section 70.

By practicing actions of steps S8 to S11 shown in FIG. 4 as explained above, it is possible to detect a shift and others for each sheet fed, and thereby, to reflect results of the detection on image forming and to form images at high speed.

The explanation will be continued by returning to FIG. 4. When a mode is judged to be a low speed mode in step S7 (step S7; Yes), sheets S are fed from main body sheet feed tray 20 without shortening a conveyance interval (step S13), because a print job is one wherein no importance is attached to a speed, or one wherein a sheet is thick, and detection is practiced by main body sheet sensor SS1 (step S14). Then, sheet S is conveyed directly to common conveyance path R4 without conveying to a delay conveyance path (step S15), and a toner image is transferred onto sheet S by transfer section 70 (step 16). In the explanation referring to FIG. 4, for a print job other than a specific print job, sheet S is fed from main body sheet feed tray 20, and is conveyed directly to common conveyance path R4 from main body conveyance path R1, to be conveyed to transfer section 70, without being conveyed to optional conveyance path R2 representing a delay conveyance path and to reversal conveyance path R3. Operations for steps S13 to S16 are repeated until the print job is completed.

Operations for feeding sheet S from main body sheet feed tray 20 in apparatus main body 2 have been explained as mentioned above. Next, operations for feeding sheet S from optional sheet feed tray 210 in optional sheet feed device 3 will be explained.

Figure 7:
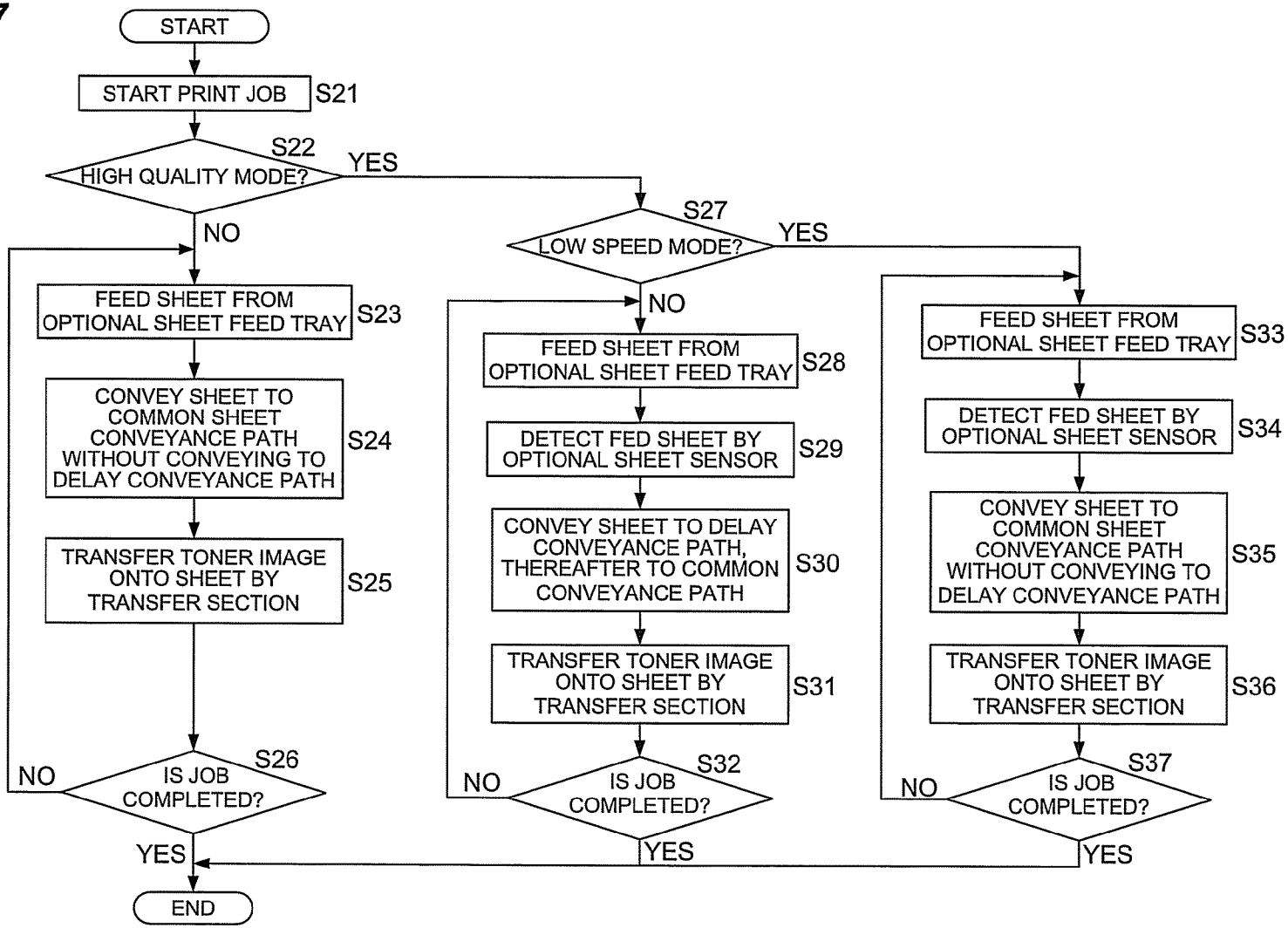
FIG. 7 is a flow chart showing operations to switch a conveyance path and to convey for a sheet that is fed from an optional sheet feed tray.

FIG. 7 is a flow chart showing operations to switch a conveyance path and to convey for a sheet that is fed from an optional sheet feed tray 210.

First, a print job established on operation and display section 105 of image forming apparatus 1 and a print job received from PC that is an outer terminal are started (step S21).

Next, judgments are made, based on establishment information for the print job, whether the print job is of a high quality mode or not (step S22).

When the print job is judged not to be of the high quality mode in step S22 (step S22; No), image forming is conducted without detecting a sheet with optional sheet sensor SS2, because the print job is one wherein no importance is attached to image quality. Specifically, for the print job which is not of a high quality mode, namely, the print job other than a specific print job, sheet S is fed from optional sheet feed tray 210 (step S23), then, sheet S is conveyed directly to common conveyance path R4 without conveying the sheet S to a delay conveyance path (step S24), and a toner image is transferred onto sheet S by transfer section 70 (step S25). In the explanation by using FIG. 8, sheet S is fed from optional sheet feed tray 210, and sheet S is conveyed directly to common conveyance path R4 to be conveyed to transfer section 70, without being conveyed to main body conveyance path R1 representing a delay conveyance path and reversal conveyance path R3. Operations covering from step S23 to step 25 are repeated until the print job is completed.

On the other hand, when the establishment information of the print job is judged to be of a high quality mode in step S22 (Step S22; Yes), the print job is judged next whether it is of a low speed mode or not based on the establishment information (step S27).

When the print job is judged not to be of a low speed mode in step S27 (Step S27; No), sheet S is conveyed, after switching a conveyance path, by considering that a plurality of sheets S are detected by optional sheet sensor SS2 to acquire information such as a shift in its early stage and by considering a period of time during which image data are corrected and an image formed on photoreceptor 410 arrives at transfer section 70. Specifically, sheet S is fed from main body sheet feed tray 210 (step S28), and the sheet S thus fed is detected optional sheet sensor SS2 (step S29). Then, for securing the conveyance distance to be long, sheet S is conveyed temporarily to a delay conveyance path, and then, sheet S is conveyed to common conveyance path R4 (step S30), and a toner image is transferred onto sheet S by transfer section 70 (step S31). Operations covering from step S28 to step S31 will be explained in detail as follows, referring to FIG. 8 and FIG. 9.

Figure 8:
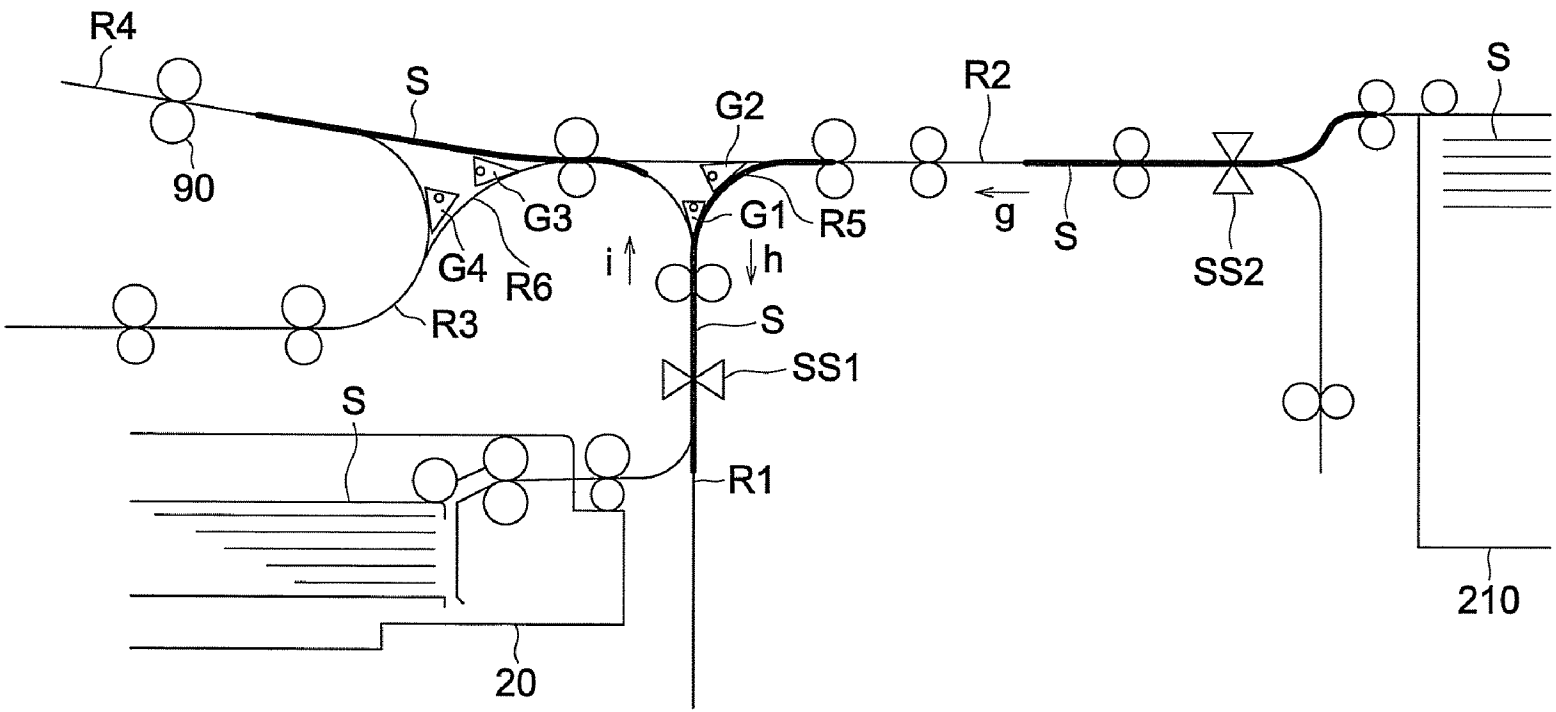
FIG. 8 is an illustration showing configuration for conveying a sheet temporarily to a conveyance path of a main body from an optional conveyance path.
Figure 9:
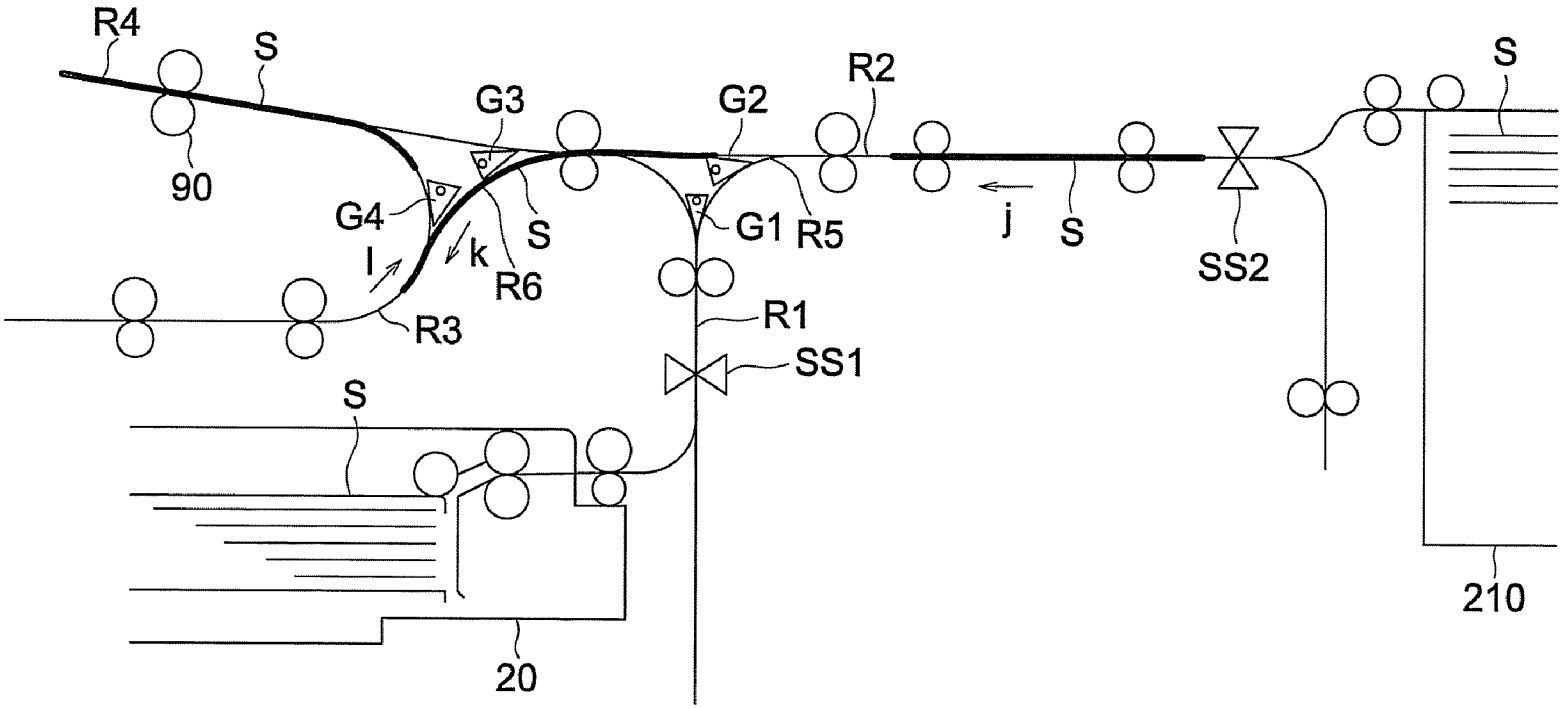
FIG. 9 is an illustration showing configuration for conveying a sheet temporarily to a reversal conveyance path from an optional conveyance path.
Figure 10:
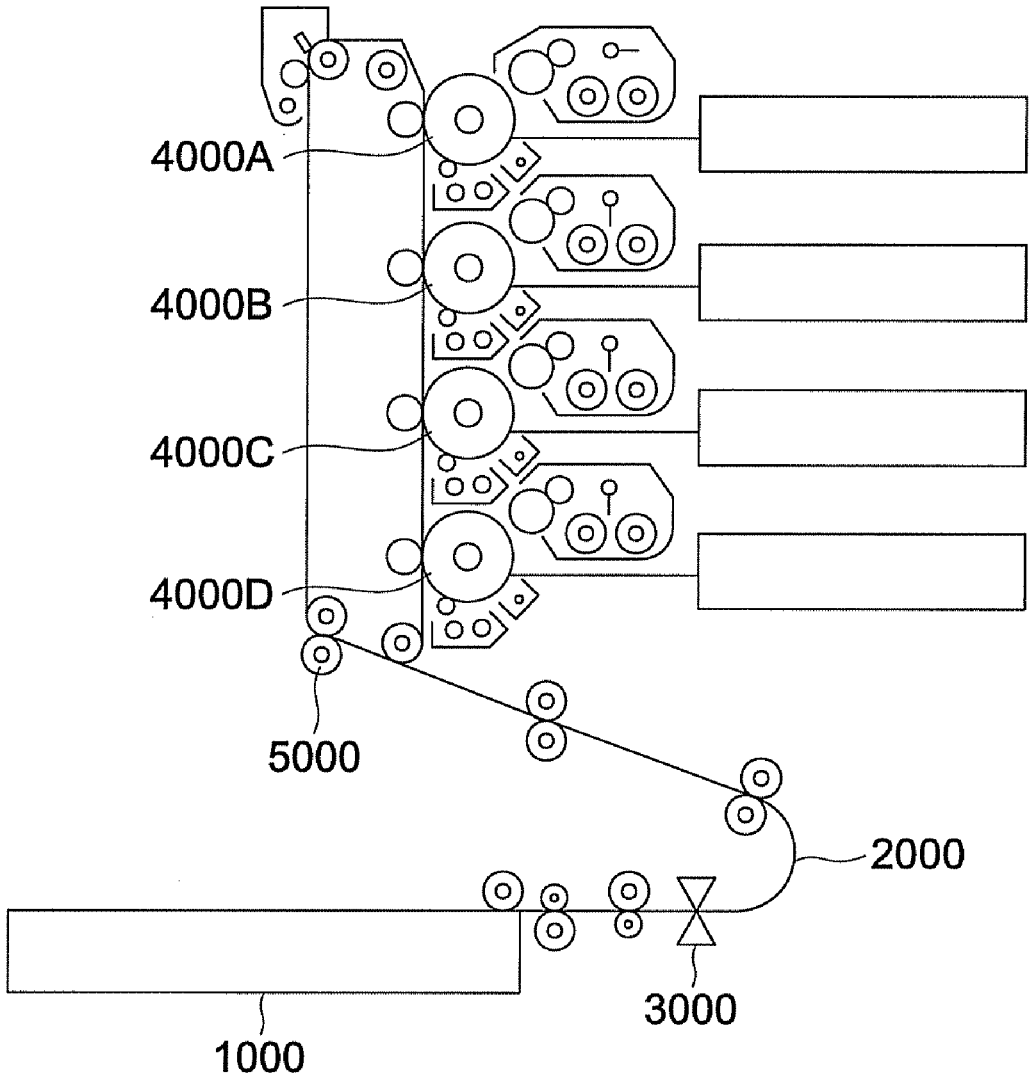
FIG. 10 is a schematic structural diagram of an ordinary image forming apparatus.

FIG. 8 is an illustration showing how sheet S is conveyed temporarily from optional conveyance path R2 to main body conveyance path R1, and FIG. 9 is an illustration showing how sheet S is conveyed temporarily from optional conveyance path R2 to reversal conveyance path R3. FIG. 6 is an illustration showing how sheet S is conveyed temporarily from main body conveyance path R1 to reversal conveyance path R3. Incidentally, in FIG. 8, optional conveyance path R2 corresponds directly to the conveyance path, and main body conveyance path R1 corresponds to a delay conveyance path. In FIG. 9, optional conveyance path R2 corresponds directly to the conveyance path, and reversal conveyance path R3 corresponds to a delay conveyance path.

First, in the explanation of the embodiment shown in FIG. 8, sheet S fed from optional sheet feed tray 210 advances through optional conveyance path R2 in the direction g, after being detected by optional sheet sensor SS2 for a shift and others. Then, sheet S is caused to advance through first joint conveyance path R5 in the direction h by operations of switching sections G2 and G1, and is conveyed to main body conveyance path R1 representing a delay conveyance path. Next, sheet S follows a route of a switchback to advance in the direction i, to be conveyed to common conveyance path R4. If the conveyance path between optional sheet sensor SS2 and transfer section 70 is secured to be long temporarily, by switching the conveyance path so that sheet S may be conveyed through main body conveyance path R1, it is possible to feed sheets S continuously from optional sheet feed tray 20 by shortening a conveyance interval, and thereby to acquire information such as a shift of each of plural sheets in its early stage. It is further possible to cause sheet S to stay on the conveyance path and thereby to delay the conveyance thereof for the period of time during which the image data are corrected and an image formed on photoreceptor 410 arrives at transfer section 70.

Next, in the explanation about an embodiment shown in FIG. 9, sheet S fed from optional sheet feed tray 210 is detected in terms of a shift by optional sheet sensor SS2, and advances through optional conveyance path R2 in the direction j. Then, owing to operations of switching sections G2 and G3, sheet S advances through second joint conveyance path R6 in direction k, and is conveyed to reversal conveyance path R3 representing a delay conveyance path. Next, sheet S follows a route of a switchback to advance in the direction 1, and is conveyed to transfer section 70 through common conveyance path R4. If the conveyance path between optional sheet sensor SS2 and transfer section 70 is secured to be long temporarily, by switching a conveyance path so that sheet S may be conveyed to reversal conveyance path R3, it is possible to feed sheets S continuously from optional sheet feed tray 210 by shortening a conveyance interval, and thereby to acquire information such as a shift of each of plural sheets in its early stage. It is further possible to cause sheet S to stay on the conveyance path and thereby to delay the conveyance thereof for the period of time during which the image data are corrected and an image formed on photoreceptor 410 arrives at transfer section 70.

By practicing actions of steps S28 to S31 shown in FIG. 7 as explained above, it is possible to detect a shift and others for each sheet fed, and thereby, to reflect results of the detection on image forming and to form images at high speed.

The explanation will be continued by returning to FIG. 7. When a mode is judged to be a low speed mode in step S27 (step S27; Yes), sheets S are fed from optional sheet feed tray 210 without shortening a conveyance interval (step S33), (step S34). Then, sheet S is conveyed to common conveyance path R4 without conveying to a delay conveyance path (step S35), and a toner image is transferred onto sheet S by transfer section 70 (step 36). In the explanation referring to FIG. 7, for a print job other than a specific print job, sheet S is fed from optional sheet feed tray 210, and is conveyed directly to common conveyance path R4 from optional conveyance path R2, to be conveyed to transfer section 70, without being conveyed to main body conveyance path R1 representing a delay conveyance path and to reversal conveyance path R3. Operations for steps S33 to S36 are repeated until the print job is completed.

In the meantime, the invention is not limited to the present embodiment, and any modification and any addition which do not depart from the spirit and scope of the invention can be include in the invention.

The invention makes it possible to provide a compact image forming apparatus wherein physical properties or positions of each sheet fed therein can be detected, and image forming at high speed can be realized based on the results of the aforesaid detections.

What is claimed is:

1. An image forming apparatus that forms an image on a sheet, comprising:

(a) a sheet feed tray on which a sheet is stacked;

(b) a sheet detector which detects physical property or a position for each of sheets fed from the sheet feed tray;

(c) an image forming section which forms an image on the basis of a detected result by the sheet detector;

(d) a transfer section which transfers the image formed by the image forming section onto the sheet;

(e) a common conveyance path through which the sheet fed from the sheet feed tray is conveyed from a registration roller to the transfer section;

(f) a direct conveyance path through which the sheet is directly fed from the sheet feed tray to the common conveyance path;

(g) a delay conveyance path in which the sheet after being branched from the direct conveyance path is joined to the common conveyance path, and is caused to delay in being fed from the sheet feed tray to the common sheet conveyance path;

(h) a conveyance section which conveys the sheet fed from the sheet feed tray to the transfer section, and (i) a controller which controls the conveyance section to convey once the sheet fed from the sheet feed tray from the direct conveyance path to the delay conveyance path, and thereafter to convey to the common conveyance path;

wherein when the sheet feed tray is a main body sheet feed tray provided in a main body of the image forming apparatus, the direct conveyance path corresponds to a main body conveyance path in which a sheet is directly fed from the main body sheet feed tray to the common conveyance path, and the delay conveyance path corresponds to a conveyance path in which a sheet is fed from an optional sheet feed tray that is connected to the main body of the image forming apparatus to the common conveyance path.

2. An image forming apparatus that forms an image on a sheet, comprising:

(a) a sheet feed tray on which a sheet is stacked;

(b) a sheet detector which detects physical property or a position for each of sheets fed from the sheet feed tray;

(c) an image forming section which forms an image on the basis of a detected result by the sheet detector;

(d) a transfer section which transfers the image formed by the image forming section onto the sheet;

(e) a common conveyance path through which the sheet fed from the sheet feed tray is conveyed from a registration roller to the transfer section;

(f) a direct conveyance path through which the sheet is directly fed from the sheet feed tray to the common conveyance path;

(g) a delay conveyance path in which the sheet after being branched from the direct conveyance path is joined to the common conveyance path, and is caused to delay in being fed from the sheet feed tray to the common sheet conveyance path;

(h) a conveyance section which conveys the sheet fed from the sheet feed tray to the transfer section, and (i) a controller which controls the conveyance section to convey once the sheet fed from the sheet feed tray from the direct conveyance path to the delay conveyance path, and thereafter to convey to the common conveyance path;

wherein when the sheet feed tray is a main body sheet feed tray provided in a main body of the image forming apparatus, the direct conveyance path corresponds to a main body conveyance path in which a sheet is directly fed from the main body sheet feed tray to the common conveyance path, and the delay conveyance path corresponds to a reversing conveyance path which causes a sheet to be reversed on which an image has been formed on a front side thereof.

3. An image forming apparatus that forms an image on a sheet, comprising:

(a) a sheet feed tray on which a sheet is stacked;

(b) a sheet detector which detects physical property or a position for each of sheets fed from the sheet feed tray;

(c) an image forming section which forms an image on the basis of a detected result by the sheet detector;

(d) a transfer section which transfers the image formed by the image forming section onto the sheet;

(e) a common conveyance path through which the sheet fed from the sheet feed tray is conveyed from a registration roller to the transfer section;

(f)a direct conveyance path through which the sheet is directly fed from the sheet feed tray to the common conveyance path;

(g) a delay conveyance path in which the sheet after being branched from the direct conveyance path is joined to the common conveyance path, and is caused to delay in being fed from the sheet feed tray to the common sheet conveyance path;

(h) a conveyance section which conveys the sheet fed from the sheet feed tray to the transfer section; and (i) a controller which controls the conveyance section to convey once the sheet fed from the sheet feed tray from the direct conveyance path to the delay conveyance path, and thereafter to convey to the common conveyance path;

wherein when the sheet feed tray is an optional sheet feed tray that is connected to a main body of the image forming apparatus, the direct conveyance path corresponds to an optional conveyance path in which a sheet is directly fed from the optional sheet feed tray to the common conveyance path, and the delay conveyance path corresponds to a main body conveyance path in which a sheet is fed from the main body sheet feed tray to the common conveyance path.

4. An image forming apparatus that forms an image on a sheet, comprising:

(a) a sheet feed tray on which a sheet is stacked;

(b) a sheet detector which detects physical property or a position for each of sheets fed from the sheet feed tray;

(c) an image forming section which forms an image on the basis of a detected result by the sheet detector;

(d) a transfer section which transfers the image formed by the image forming section onto the sheet;

(e) a common conveyance path through which the sheet fed from the sheet feed tray is conveyed from a registration roller to the transfer section;

(f) a direct conveyance path through which the sheet is directly fed from the sheet feed tray to the common conveyance path;

(g) a delay conveyance path in which the sheet after being branched from the direct conveyance path is joined to the common conveyance path, and is caused to delay in being fed from the sheet feed tray to the common sheet conveyance path;

(h) a conveyance section which conveys the sheet fed from the sheet feed tray to the transfer section; and (i) a controller which controls the conveyance section to convey once the sheet fed from the sheet feed tray from the direct conveyance path to the delay conveyance path, and thereafter to convey to the common conveyance path;

wherein when the sheet feed tray is an optional sheet feed tray that is connected to a main body of the image forming apparatus, the direct conveyance path corresponds to an optional conveyance path in which a sheet is directly fed from the optional sheet feed tray to the common conveyance path, and the delay conveyance path corresponds to a reversing conveyance path which causes a sheet to be reversed on which an image has been formed on a front side thereof.

5. The image forming apparatus of claim 4, wherein the controller controls the conveyance section to convey the sheet to the common conveyance path after conveying to the delay conveyance path with respect to a specific print job.

6. The image forming apparatus of claim 5, wherein the controller controls the conveyance section to convey the sheet from the sheet feed tray to the common conveyance path through the direct conveyance path with respect to a print job other than the specific print job.

7. The image forming apparatus of claim 4, wherein the sheet detector is provided upstream of the common conveyance path along a sheet conveyance direction.

8. The image forming apparatus of claim 4, wherein the sheet detector detects a shift of a sheet in a direction perpendicular to a sheet conveyance direction.

9. The image forming apparatus of claim 4, wherein the sheet detector detects a width of a sheet in a direction perpendicular to a sheet conveyance direction.

10. The image forming apparatus of claim 4, wherein the sheet detector detects a whiteness of a sheet.

11. The image forming apparatus of claim 3, wherein the controller controls the conveyance section to convey the sheet to the common conveyance path after conveying to the delay conveyance path with respect to a specific print job.

12. The image forming apparatus of claim 11, wherein the controller controls the conveyance section to convey the sheet from the sheet feed tray to the common conveyance path through the direct conveyance path with respect to a print job other than the specific print job.

13. The image forming apparatus of claim 3, wherein the sheet detector is provided upstream of the common conveyance path along a sheet conveyance direction.

14. The image forming apparatus of claim 3, wherein the sheet detector detects a shift of a sheet in a direction perpendicular to a sheet conveyance direction.

15. The image forming apparatus of claim 3, wherein the sheet detector detects a width of a sheet in a direction perpendicular to a sheet conveyance direction.

16. The image forming apparatus of claim 3, wherein the sheet detector detects a whiteness of a sheet.

* * * * *